US010446376B2

(12) United States Patent
Cox

(10) Patent No.: US 10,446,376 B2
(45) Date of Patent: Oct. 15, 2019

(54) COMPOUND IDENTIFICATION USING MULTIPLE SPECTRA AT DIFFERENT COLLISION ENERGIES

(71) Applicant: DH TECHNOLOGIES DEVELOPMENT PTE. LTD., Singapore (SG)

(72) Inventor: David Michael Cox, Toronto (CA)

(73) Assignee: DH Technologies Development Pte. Ltd., Singapore (SG)

( * ) Notice: Subject to any disclaimer, the term of this patent is extended or adjusted under 35 U.S.C. 154(b) by 270 days.

(21) Appl. No.: 14/443,935

(22) PCT Filed: Nov. 21, 2013

(86) PCT No.: PCT/IB2013/002607
§ 371 (c)(1),
(2) Date: May 19, 2015

(87) PCT Pub. No.: WO2014/096915
PCT Pub. Date: Jun. 26, 2014

(65) Prior Publication Data

US 2015/0303045 A1 Oct. 22, 2015

Related U.S. Application Data

(60) Provisional application No. 61/740,369, filed on Dec. 20, 2012.

(51) Int. Cl.
*H01J 49/00* (2006.01)

(52) U.S. Cl.
CPC ..... *H01J 49/0045* (2013.01); *H01J 49/0036* (2013.01)

(58) Field of Classification Search
CPC .... H01J 49/004; H01J 49/063; H01J 49/0009; H01J 49/005; H01J 49/429;
(Continued)

(56) References Cited

U.S. PATENT DOCUMENTS

2006/0003385 A1 1/2006 Aguilera et al.
2010/0179766 A1 7/2010 Kim et al.
2012/0241603 A1 9/2012 Scigocki

FOREIGN PATENT DOCUMENTS

EP 1457776 A2 9/2004
EP 2450815 A1 5/2012
(Continued)

OTHER PUBLICATIONS

Guo et al., "Optimization of Peptide Fragmentation Patterns on a Hybrid Quadrupole—Time of Flight Mass Spectrometer", Poster, Applied Biosystems/MDS SCIEX, Toronto, Canada, 2002. p. 1.*
(Continued)

*Primary Examiner* — Xiaoyun R Xu
(74) *Attorney, Agent, or Firm* — John R. Kasha; Kelly L. Kasha; Kasha Law LLC

(57) ABSTRACT

Systems and methods are provided for compound identification using multiple spectra that are a function of a variable instrument parameter that affects the intensity of fragment ions. A plurality of acquired fragment ion spectra that are a function of a variable instrument parameter for at least one ion are received from a mass spectrometer using a processor. The at least one ion is identified by comparing rates of change of mass intensity, with respect to the variable instrument parameter, for acquired and known fragment ions using the processor. Specifically, one or more acquired rates of change calculated for acquired fragment ions from the plurality of acquired fragment ion spectra are compared with one or more known rates of change calculated for one or more stored fragment ions of one or more known compounds in a database of known compounds.

8 Claims, 4 Drawing Sheets

(58) Field of Classification Search
CPC .. H01J 49/0045; G01N 33/6848; A23L 33/18; A23L 33/185; A23L 2/66
See application file for complete search history.

(56) References Cited

FOREIGN PATENT DOCUMENTS

WO 2009138179 A2 11/2009
WO 2012-111249 A1 8/2012

OTHER PUBLICATIONS

Rogalski et al., "Statistical Evaluation of Electrospray Tandem Mass Spectra for Optimized Peptide Fragmentation", J. Am. Soc. Mass Spectrom., 2005, v. 16, pp. 505-514.*
MacLean et al.,"Effect of Collision Energy Optimization on the Measurement of Peptides by Selected Reaction Monitoring (SRM) Mass Spectrometry",Anal. Chem., Dec. 15, 2010, v. 82, No. 24, pp. 10116-10124.*
Geiger et al.,"Proteomics on an Orbitrap Benchtop Mass Spectrometer Using All-Ion Fragmentation", Mol. & Cel. Proteomics, 2010, v. 9, pp. 2252-2261.*
Diedrich et al., "Energy dependence of HCD on peptide fragmentation: Stepped collisional energy finds the sweet spot", J. Am. Soc. Mass Spectrom., 2013, v. 24, No. 11, pp. 1-17.*
Cao et al.,"Strategy Integrating Stepped Fragmentation and Glycan Diagnostic Ion-Based Spectrum Refinement for the Identification of Core Fucosylated Glycoproteome Using Mass Spectrometry", Anal. Chem., 2014, v. 86, pp. 6804-6811.*
Hill et al., "Correlation of Ecom50 values between mass spectrometers: effect of collision cell RF voltage on calculated survival yield", Rapid Commun. Mass Spectrom., 2012, v. 26, No. 19, pp. 2303-2310 (author manuscript).*
Waters, Creating and Using LC/MS and LC/MS/MS Libraries, Waters Corporation, 2007. (Year: 2007).*
International Search Report and Written Opinion for PCT/IB2013/002607, dated Apr. 22, 2014.

* cited by examiner

100

300

COMPOUND IDENTIFICATION USING MULTIPLE SPECTRA AT DIFFERENT COLLISION ENERGIES

CROSS REFERENCE TO RELATED APPLICATION

This application claims the benefit of U.S. Provisional Patent Application Ser. No. 61/740,369, filed Dec. 20, 2012, the content of which is incorporated by reference herein in its entirety.

INTRODUCTION

Identifying a compound from tandem mass spectrometry, or mass spectrometry/mass spectrometry (MS/MS), spectra is often ambiguous. The existing algorithms (dot product, probability based, etc.) give a score representing the similarity between the acquired spectra and the library spectra. However, it is difficult to know what a good score is. In other words, it is difficult to know what score will confidently identify a compound.

Some compounds have very few, or no, distinguishing fragments, which result in scores that do not represent the confidence in the identification. For example, a compound with no fragments will get a very high Fit and Purity score, but so will many other compounds that have poor fragmentation. This makes it hard to distinguish false positives from a true hit.

In other cases, a moderately rich fragmentation pattern has interference from a co-eluting compound, which adversely affects the score. This makes it difficult to know what score is appropriate to confidently identify the compound.

Historically, library searching was most often used on gas chromatography coupled mass spectrometry (GC-MS) systems electron impact (EI) sources. These systems and sources had a very well defined energy, leading to very reproducible spectra among different laboratories and even across instrument models. For liquid chromatography coupled tandem mass spectrometry (LC-MS/MS) spectra, the fragmentation pattern depends heavily on the collision energy (CE) used and can vary somewhat between instruments. This makes it difficult to set appropriate scores for identifying a compound across different laboratories.

SUMMARY

A system is disclosed for compound identification using multiple spectra that are a function of a variable instrument parameter that affects the intensity of fragment ions. A mass spectrometer analyzes a sample. Within each cycle of the analysis the mass spectrometer selects at least one ion and fragments that ion using two or more values for a variable instrument parameter that affects the intensity of fragment ions. A plurality of fragment ion spectra are produced that are a function of the variable instrument parameter.

A processor receives the plurality of acquired fragment ion spectra for the at least one ion from the mass spectrometer. The processor identifies the at least one ion by comparing rates of change of mass intensity, with respect to the variable instrument parameter, for acquired and known fragment ions. Specifically, one or more acquired rates of change calculated for acquired fragment ions from the plurality of acquired fragment ion spectra are compared with one or more known rates of change calculated for one or more stored fragment ions of one or more known compounds in a database of known compounds. The database of known compounds includes for each fragment ion of each known compound a plurality of known fragment ion spectra that are also a function of the variable instrument parameter.

A method is disclosed for compound identification using multiple spectra that are a function of a variable instrument parameter that affects the intensity of fragment ions. A plurality of acquired fragment ion spectra that are a function of a variable instrument parameter for at least one ion are received from a mass spectrometer using a processor.

The at least one ion is identified by comparing rates of change of mass intensity, with respect to the variable instrument parameter, for acquired and known fragment ions using the processer. Specifically, one or more acquired rates of change calculated for acquired fragment ions from the plurality of acquired fragment ion spectra are compared with one or more known rates of change calculated for one or more stored fragment ions of one or more known compounds in a database of known compounds.

A computer program product is disclosed that includes a non-transitory and tangible computer-readable storage medium whose contents include a program with instructions being executed on a processor so as to perform a method for compound identification using multiple spectra that are a function of a variable instrument parameter that affects the intensity of fragment ions. In various embodiments, the method includes providing a system, wherein the system comprises one or more distinct software modules, and wherein the distinct software modules comprise a measurement module and an analysis module.

The measurement module receives a plurality of acquired fragment ion spectra that are a function of a variable instrument parameter for at least one ion from a mass spectrometer using the measurement module. The analysis module identifies the at least one ion by comparing rates of change of mass intensity, with respect to the variable instrument parameter, for acquired and known fragment ions. Specifically, one or more acquired rates of change calculated for acquired fragment ions from the plurality of acquired fragment ion spectra are compared with one or more known rates of change calculated for one or more stored fragment ions of one or more known compounds in a database of known compounds.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Figure 1:
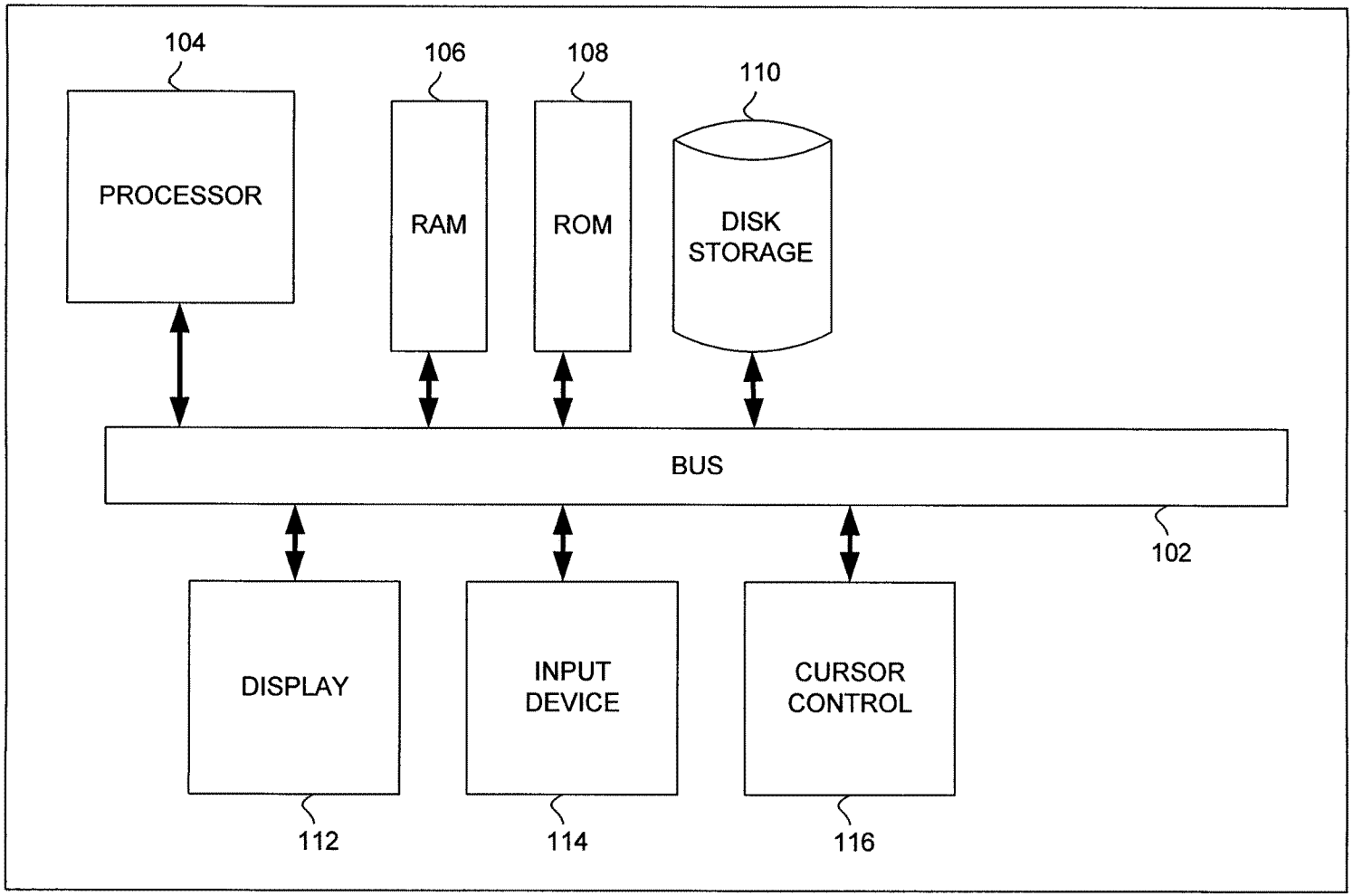
FIG. 1 is a block diagram that illustrates a computer system, upon which embodiments of the present teachings may be implemented.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively hard-wired circuitry may be used in place of or in combination with software instructions to implement the present teachings. Thus implementations of the present teachings are not limited to any specific combination of hardware circuitry and software.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Systems and Methods for Compound Identification

As described above, trying to identify a compound from tandem mass spectrometry spectra can often produce ambiguous results. This can be due to the difficulty in scoring comparisons of the acquired spectra to a library or database of stored spectra for known compounds. In addition, some tandem mass spectrometry methods, such as liquid chromatography coupled tandem mass spectrometry (LC-MS/MS), produce spectra that depend heavily on a variable instrument parameter, such as collision energy (CE). As a result, it is difficult to compare the results from one instrument across different instruments or laboratories.

In various embodiments, a compound is identified by comparing the rate of change of one or more acquired mass intensities, with respect to a variable instrument parameter, to the rate of change of one or more database stored mass intensities, with respect to the same variable instrument parameter. One skilled in the art can appreciate that a mass intensity can also include a mass-to-charge ratio (m/z) intensity. The variable instrument parameter is a parameter that affects the intensity of fragment ions.

Comparing rates of change of mass intensity with respect to a variable instrument parameter makes the process of identifying a compound less ambiguous. Ambiguity is reduced because a rate of change contains more information. It contains information from at least two measurements of the mass intensity. Conventionally, a comparison of the mass intensity, or a determination of whether or not the mass is there, is based on just one measurement of the mass intensity.

Also, using rates of change of mass intensity to identify compounds improves the consistency of results across different instruments or laboratories. Different instruments or laboratories can measure different mass intensity absolute values for a compound of interest, if they use different values for the variable instrument parameter. These mass intensity absolute values for the compound of interest can also vary from the mass intensity absolute values stored in the database of spectra for known compounds.

However, as long as the different instruments or laboratories produce mass intensity values that share a common range of values for the variable instrument parameter with the database of spectra for known compounds that is searched, the results will be consistent. This is because the rate of change of mass intensity values for a compound with respect to a common range of values for a variable instrument parameter will be similar across all instruments, laboratories, and the database of spectra for known compounds for the common range. This is true even though the mass intensity absolute values across those instruments, laboratories, and the database of spectra for known compounds may be different at specific values over the common range.

In various embodiments, collision energy (CE) is the variable instrument parameter that is used to identify a compound from tandem mass spectrometry spectra. CE is a parameter that affects the intensity of fragment ions. A fast tandem mass spectrometer can perform multiple fragmentation ion scans, or product ion scans, within a single cycle time of the instrument. As a result, a compound of interest, or precursor ion, can be fragmented using several different CEs per cycle, producing a plurality of product ion spectra per cycle. The combined set of product ion spectra provide information on how the mass intensity of each fragment or product ion changes with respect to CE.

A rate of change of the mass intensity of each product ion with respect to CE can be calculated. The rate of change of the mass intensity of one or more product ions with respect to CE can be used to identify the precursor ion. The rate or rates of change calculated for the one or more product ions can be compared to the rate or rates of change of product ions of known compounds.

Some conventional libraries or databases of known compounds include spectra for product ions that were collected using different collision energies. Such conventional libraries are used to compare data from different instruments that may have been collected at different CEs. As a result, they are designed for comparing one spectrum at a time. In other words, they do not readily provide a rate of change of a product ion with respect to the CE. However, all the data is inherent in such a database. Consequently, even some conventional libraries can be used to identify a compound from a rate of change, if a rate of change for one or more product ion of the libraries is also calculated.

The rate of change of mass intensity with respect to CE, or mass intensity as function of CE, of an acquired product ion can be compared to the mass intensity as function of CE of a stored product ion of a library of spectra of known compounds in a variety of different ways. For example, the mass intensity versus CE can be plotted for every product ion, and the shape of these breakdown curves can be compared or measured against library data.

In another embodiment, the acquired data can be converted to an image. Image comparison tools are then used to score the match. Elements of an image, for example, are a combination of the mass, mass intensity, and CE. The extra dimension of CE makes it significantly easier to extract multiple compound identifications. For example, using common image matching algorithms (cross correlation matching) one can confidently identify one compound, remove these features from the image, and then identify other compounds.

Although the examples herein describe systems and methods that identify a compound from tandem mass spectrometer data by using the rate of change of mass intensity as a function of CE, various embodiments are not limited to tandem mass spectrometry or a rate of change that is a function of CE.

System for Compound Identification

Figure 2:
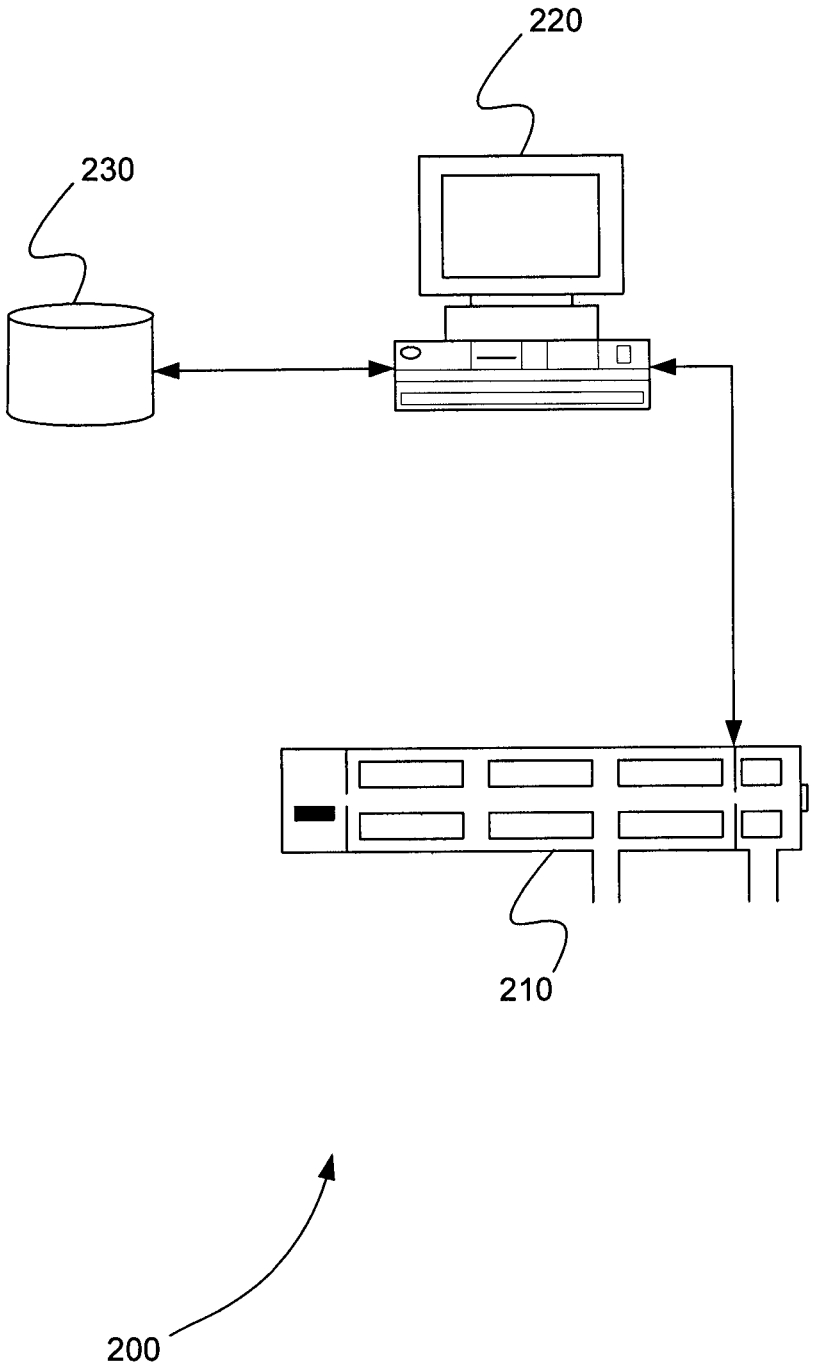
FIG. 2 is a schematic diagram showing a system for compound identification using multiple spectra that are a function of a variable instrument parameter that affects the intensity of fragment ions, in accordance with various embodiments.

FIG. 2 is a schematic diagram showing a system 200 for compound identification using multiple spectra that are a function of a variable instrument parameter that affects the intensity of fragment ions, in accordance with various embodiments. System 200 includes mass spectrometer 210, processor 220, and database 230.

Mass spectrometer 210 can include one or more physical mass analyzers that perform one or more mass analyses. A mass analyzer of a tandem mass spectrometer can include , but is not limited to, a time-of-flight (TOF), quadrupole, an ion trap, a linear ion trap, an orbitrap, or a Fourier transform mass analyzer. Mass spectrometer 210 can also include one or more separation devices (not shown). The separation device can perform a separation technique that includes, but is not limited to, liquid chromatography, gas chromatography, capillary electrophoresis, or ion mobility. Mass spectrometer 210 can include separating mass spectrometry stages or steps in space or time, respectively.

Processor 220 can be, but is not limited to, a computer, microprocessor, or any device capable of sending and receiving control signals and data to and from mass spectrometer 210 and processing data. Processor 220 is in communication with mass spectrometer 210.

Database 230 can include magnetic or electronic storage. Database 230 can be part of a memory for processor 220 or it can be a separate memory. Database 230 can include software components in addition to hardware components.

Mass spectrometer 210 analyzes a sample. Within each cycle of the analysis, mass spectrometer 210 selects at least one ion and fragments that ion using two or more values for a variable instrument parameter that affects the intensity of fragment ions. A plurality of fragment ion spectra are produced that are a function of the variable instrument parameter.

Mass spectrometer 210 analyzes the sample using mass spectrometry/mass spectrometry (MS/MS), for example. In various alternative embodiments, spectrometer 210 analyzes the sample using mass spectrometry/mass spectrometry/mass spectrometry ($MS^3$), for example. The variable instrument parameter is collision energy (CE), for example.

Database 230 stores fragment ion spectra that are a function of the variable instrument parameter for known compounds. Database 230 includes for each fragment ion of each known compound a plurality of fragment ion spectra that are a function of the variable instrument parameter.

Processor 220 receives the plurality of acquired fragment ion spectra for the at least one ion from mass spectrometer 210. Processor 220 receives the plurality of acquired fragment ion spectra in a post-acquisition step, for example. Processor 220 identifies the at least one ion by comparing the rates of change of mass intensity with respect to the variable instrument parameter of acquired and known fragments ions. More specifically, processor 220 compares one or more acquired rates of change of mass intensity, with respect to the variable instrument parameter, calculated for one or more acquired fragment ions from the plurality of acquired fragment ion spectra with one or more known rates of change of mass intensity, with respect to the variable instrument parameter, calculated for one or more stored fragment ions of one or more known compounds in database 230.

In various embodiments, processor 220 identifies the at least one ion by scoring the comparison of the rates of change of acquired and known fragment ions, calculating scores for a list of known compounds based on the scores of the comparison, and selecting a known compound from the list.

In various embodiments, comparing the rates of change involves comparing acquired and known breakdown curves. More specifically, one or more acquired breakdown curves of mass intensity versus the variable instrument parameter calculated for one or more acquired fragment ions from the plurality of acquired fragment ion spectra are compared with one or more known breakdown curves of mass intensity versus the variable instrument parameter calculated for one or more stored fragment ions of one or more known compounds in database 230.

In various embodiments, comparing the rates of change involves comparing acquired and known images of fragment ion data. Each element of each image is, for example, a combination of mass, mass intensity, and collision energy (CE). More specifically, one or more acquired images calculated for one or more acquired fragment ions from the plurality of acquired fragment ion spectra are compared with one or more known images calculated for one or more stored fragment ions of one or more known compounds in database 230.

Method for Compound Identification

Figure 3:
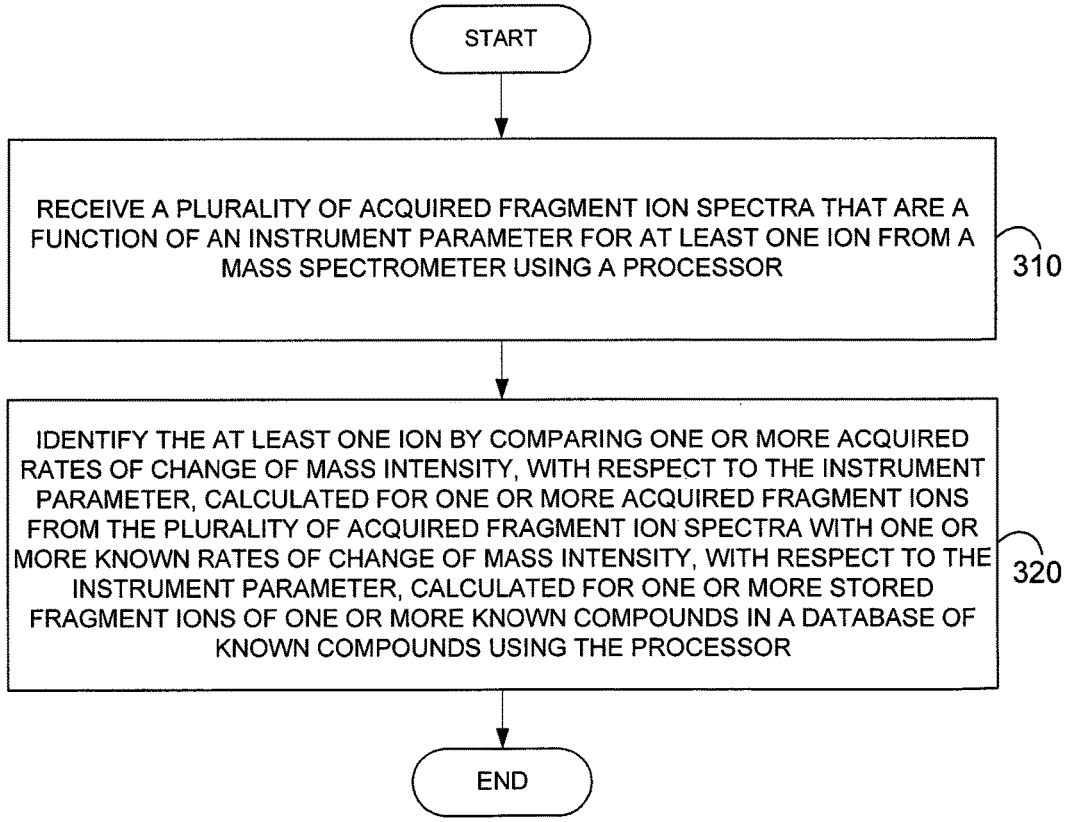
FIG. 3 is an exemplary flowchart showing a method for compound identification using multiple spectra that are a function of a variable instrument parameter that affects the intensity of fragment ions, in accordance with various embodiments.

FIG. 3 is an exemplary flowchart showing a method 300 for compound identification using multiple spectra that are a function of a variable instrument parameter that affects the intensity of fragment ions, in accordance with various embodiments.

In step 310 of method 300, a plurality of acquired fragment ion spectra that are a function of a variable instrument parameter for at least one ion are received from a mass spectrometer using a processor. The plurality of acquired fragment ion spectra are produced from an analysis of a sample by the mass spectrometer. Within each cycle of the analysis the mass spectrometer selects the at least one ion and fragments the at least one ion using two or more values for the variable instrument parameter that affects the intensity of fragment ions, producing the plurality of acquired fragment ion spectra.

In step 320, the at least one ion is identified by comparing rates of change of mass intensity, with respect to the variable instrument parameter, for acquired and known fragment ions using the processor. One or more acquired rates of change calculated for acquired fragment ions from the plurality of acquired fragment ion spectra are compared with one or more known rates of change calculated for one or more stored fragment ions of one or more known compounds in a database of known compounds. The database of known compounds includes for each fragment ion of each known compound a plurality of known fragment ion spectra that are also a function of the variable instrument parameter.

Computer Program Product for Compound Identification

In various embodiments, computer program products include a tangible computer-readable storage medium whose contents include a program with instructions being executed on a processor so as to perform a method for compound identification using multiple spectra that are a function of a variable instrument parameter that affects the intensity of fragment ions. This method is performed by a system that includes one or more distinct software modules.

Figure 4:
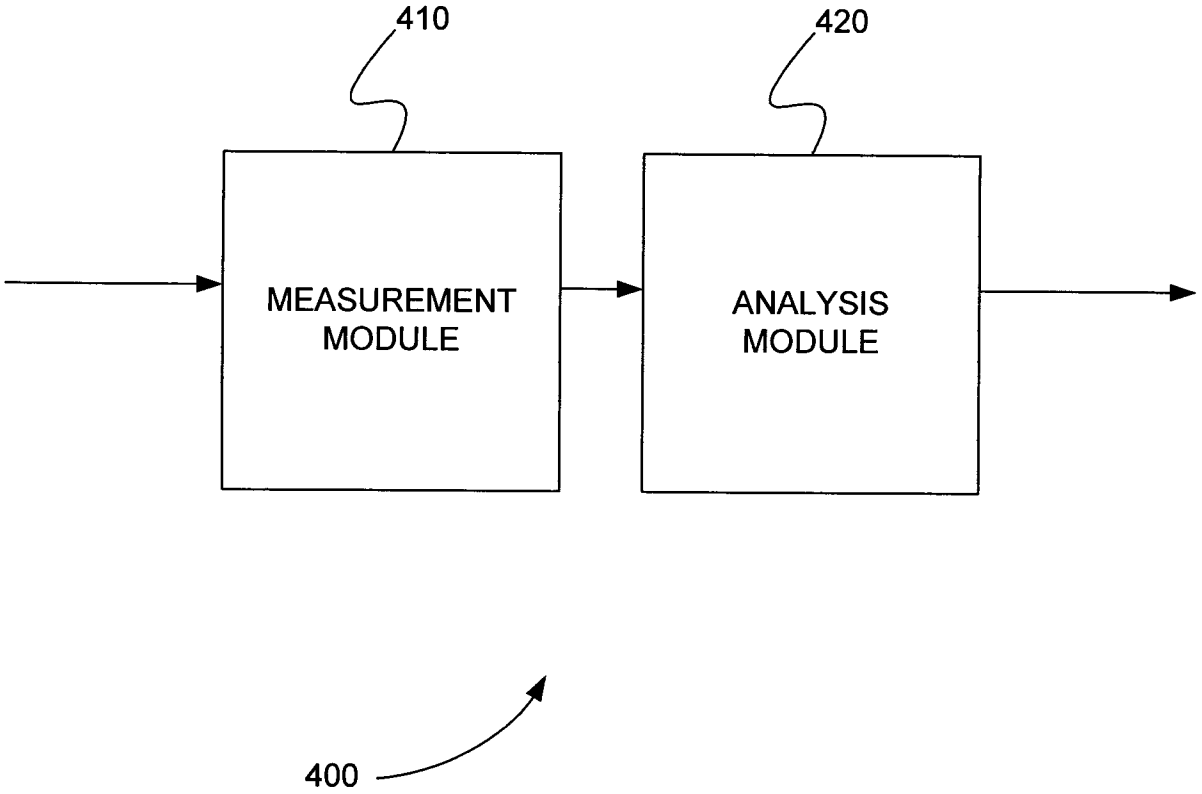
FIG. 4 is a schematic diagram of a system that includes one or more distinct software modules that performs a method for compound identification using multiple spectra that are a function of a variable instrument parameter that affects the intensity of fragment ions, in accordance with various embodiments.

FIG. 4 is a schematic diagram of a system 400 that includes one or more distinct software modules that performs a method for compound identification using multiple spectra that are a function of a variable instrument parameter that affects the intensity of fragment ions, in accordance with various embodiments. System 400 includes measurement module 410 and analysis module 420.

Measurement module 410 receives a plurality of acquired fragment ion spectra that are a function of a variable instrument parameter for at least one ion from a mass spectrometer using the measurement module. The plurality of acquired fragment ion spectra are produced from an analysis of a sample by the mass spectrometer. Within each cycle of the analysis the mass spectrometer selects the at least one ion and fragments the at least one ion using two or more values for the variable instrument parameter that affects the intensity of fragment ions, producing the plurality of acquired fragment ion spectra.

Analysis module 420 identifies the at least one ion by comparing rates of change of mass intensity, with respect to the variable instrument parameter, for acquired and known fragment ions. One or more acquired rates of change calculated for acquired fragment ions from the plurality of acquired fragment ion spectra are compared with one or more known rates of change calculated for one or more stored fragment ions of one or more known compounds in a database of known compounds. The database of known compounds includes for each fragment ion of each known compound a plurality of known fragment ion spectra that are also a function of the variable instrument parameter.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A system for compound identification using multiple spectra that are a function of a variable instrument parameter that affects the intensity of fragment ions, comprising:

a mass spectrometer that analyzes a sample and within each cycle of the mass spectrometer selects at least one ion and fragments the at least one ion using two or more values for a variable instrument parameter that affects the intensity of fragment ions, producing a plurality of acquired fragment ion spectra that are a function of the variable instrument parameter;

a database of known compounds that includes for each fragment ion of each known compound a plurality of fragment ion spectra that are a function of the variable instrument parameter; and a processor in communication with the mass spectrometer and the database that receives the plurality of acquired fragment ion spectra for the at least one ion from the mass spectrometer, calculates one or more sample fragment ion rates of change of mass intensity, with respect to the variable instrument parameter, for one or more sample fragment ions from the plurality of acquired fragment ion spectra, calculates one or more database fragment ion rates of change of mass intensity, with respect to the variable instrument parameter, for one or more database fragment ions of one or more known compounds in the database, and compares the one or more sample fragment ion rates of change of mass intensity with the one or more database fragment ion rates of change of mass intensity to identify the at least one ion.

2. The system of claim 1, wherein the mass spectrometer analyzes the sample using tandem mass spectrometry, or mass spectrometry/mass spectrometry (MS/MS).

3. The system of claim 1, wherein the mass spectrometer analyzes the sample using mass spectrometry/mass spectrometry/mass spectrometry ($MS^3$).

4. The system of claim 1, wherein the variable instrument parameter comprises collision energy (CE).

5. A method for compound identification using multiple spectra that are a function of a variable instrument parameter that affects the intensity of fragment ions, comprising:

receiving a plurality of acquired fragment ion spectra that are a function of a variable instrument parameter for at least one ion from a mass spectrometer using a processor, wherein the mass spectrometer analyzes a sample and within each cycle of the mass spectrometer selects the at least one ion and fragments the at least one ion using two or more values for the variable instrument parameter that affects the intensity of fragment ions, producing the plurality of acquired fragment ion spectra;

calculating one or more sample fragment ion rates of change of mass intensity, with respect to the variable instrument parameter, for one or more sample fragment ions from the plurality of acquired fragment ion spectra;

calculating one or more database fragment ion rates of change of mass intensity, with respect to the variable instrument parameter, for one or more database fragment ions of one or more known compounds in the database, wherein the database of known compounds includes for each fragment ion of each known compound a plurality of fragment ion spectra that are a function of the variable instrument parameter; and comparing the one or more sample fragment ion rates of change of mass intensity with the one or more database fragment ion rates of change of mass intensity to identify the at least one ion using the processor.

6. The method of claim 5, wherein the mass spectrometer analyzes the sample using tandem mass spectrometry, or mass spectrometry/mass spectrometry (MS/MS).

7. The method of claim 5, wherein the mass spectrometer analyzes the sample using mass spectrometry/mass spectrometry/mass spectrometry ($MS^3$).

8. The method of claim 5, wherein the variable instrument parameter comprises collision energy (CE).

* * * * *